United States Patent [19]

Knapp

[11] Patent Number: 4,993,982

[45] Date of Patent: Feb. 19, 1991

[54] METHOD AND APPARATUS FOR PRODUCING NEON SIGNS

[75] Inventor: John R. Knapp, Bellevue, Wash.

[73] Assignee: Mid Mountain Materials, Inc., Redmond, Wash.

[21] Appl. No.: 309,775

[22] Filed: Feb. 9, 1989

Related U.S. Application Data

[63] Continuation of Ser. No. 926,913, Mar. 11, 1986, abandoned.

[51] Int. Cl.[5] ..... G09F 13/26

[52] U.S. Cl. ..... 445/22; 40/545

[58] Field of Search ..... 445/22; 65/63, 64; 40/545, 549

[56] References Cited

U.S. PATENT DOCUMENTS

| | | | |
|---|---|---|---|
| 1,923,148 | 8/1933 | Hotchner | 40/545 |
| 2,182,233 | 12/1939 | Pearlman | 40/545 |
| 2,202,396 | 5/1940 | Owen | 40/545 |
| 3,073,051 | 1/1963 | Baker | 40/545 |
| 4,265,039 | 5/1981 | Brooks | 40/549 |

*Primary Examiner*—Kurt Rowan

*Attorney, Agent, or Firm*—Don R. Mollick

[57] ABSTRACT

A method and apparatus for producing neon and similar signs. The method includes a direct bending of glass tubing over a drawing which is protected by a translucent heat resistant sheet. The sheet and process for its production are also described.

8 Claims, 1 Drawing Sheet

METHOD AND APPARATUS FOR PRODUCING NEON SIGNS

This is a continuation of application Ser. No. 061926,913 filed 3-11-86 now abandoned.

FIELD OF INVENTION

This invention pertains to the production of neon and similar signs, particularly to methods of transferring drawn designs to bent glass tubing and with still greater particularity to transfer sheets used in the forming of glass tubing.

BACKGROUND OF INVENTION

The primary method for producing neon and similar signs or artwork has not changed for sixty years. First, an artist draws the design for the sign on paper or plastic film. The design so drawn is then placed over a temperature resistant sheet of material. The primary material formerly used was an asbestos paper. With present concerns about the long term toxicity of asbestos, an opaque silicone rubber impregnated fiberglass sheet is now frequently substituted. A sheet of carbon paper is placed between the drawing and the heat resistant material. When the drawing is traced with a stylus the carbon paper transfers the image to the heat resistant material. Glass tubing is then bent by use of a torch to the shape of the pattern on the sheet goods. The bender places the hot tubing on the sheet and bends it to the shape of the pattern left by the carbon paper. Finally the tube is evacuated, filled with a suitable gas at low pressure and electrode fitted. When electricity is applied to the electrodes the gas ionizes and glows in a characteristic color producing the sign.

Several problems have arisen with this method. First, due to safety considerations, asbestos paper, the most suitable material, has become unavailable. The silicone rubberized fiberglass material is expensive and difficult to work with particularly due to smoke formulation on heating and the over suppleness of fabric. In addition, the drawing of the design and its subsequent tracing requires lengthy labor of skilled artisans which greatly increases the cost of the sign. Accordingly, a demand exists for a method of producing signs directly from a drawing without the use of dangerous materials.

SUMMARY OF THE INVENTION

The invention provides a method and apparatus for producing neon and similar signs at minimal cost. This method removes a former step from the manufacturing process. The method allows production of signs directly from the drawing and does not utilize any dangerous materials. A unique translucent heat resistant material is used which is available at relatively low cost.

The method is similar to the method formerly used in that the first step is production of a drawing of the sign by an artist. The drawing is then placed on a standard metal work table and covered by a sheet of translucent heat resistant flexible material. The drawing is visible through the material. The tubing bender then bends the tubing on the material to the shape of the drawing beneath. The material protects the drawing from heat yet allows the tubing to be bent. When the tubing is in the shape of the drawing it is evacuated and electrodes fitted.

DESCRIPTION OF THE PREFERRED EMBODIMENT

Figure 1:
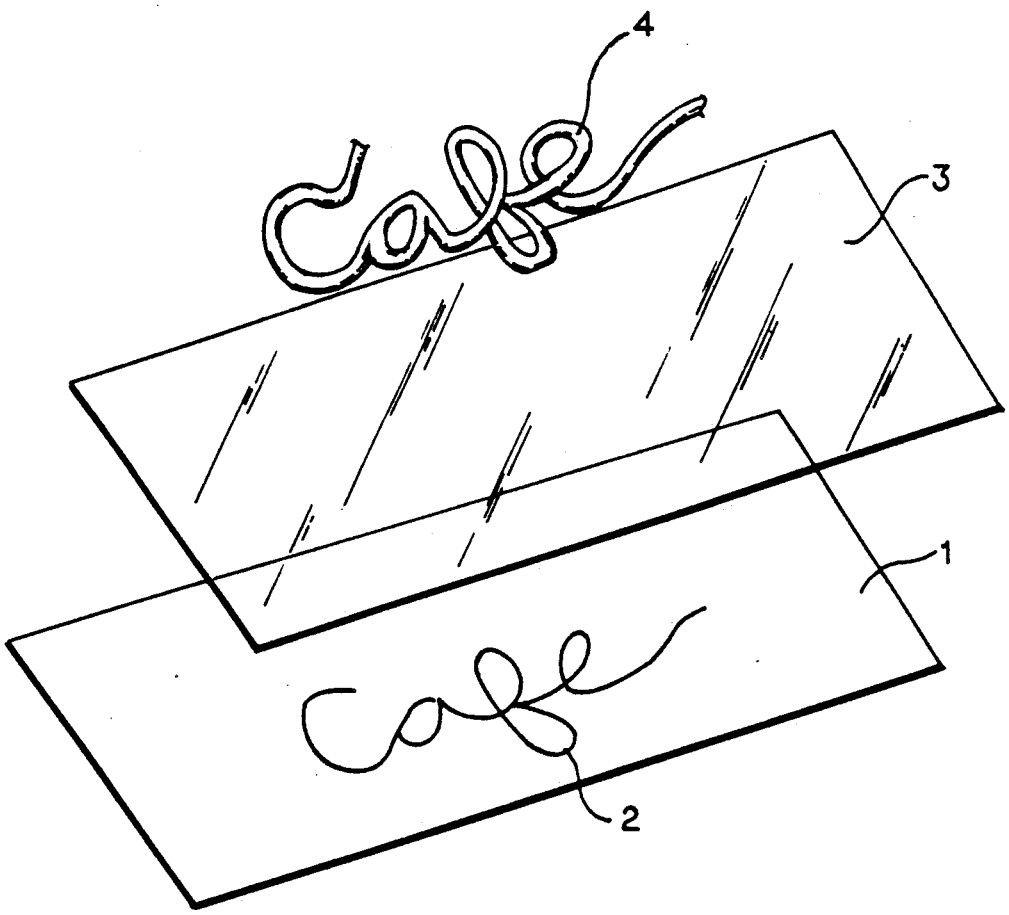
FIG. 1 is an exploded view of the method of the invention.

FIG. 1 is an exploded drawing of the method used in the invention. First an image 2 is produced on a sheet of paper 1 or similar material. Conventionally image 2 is produced manually by an artist directly on sheet 1. Under special circumstances where, for example, large quantity of signs are needed with the same design, image 2 could be produced by a stencil, or printed. A piece 3 of a flexible translucent or transparent heat resistant material is then placed over image 2. In the preferred embodiment this material is a silicone impregnated fiberglass material. Image 2 must be visible through piece 3. Piece 3 must also protect image 2 from subsequent heat damage. Glass tubing 4 is then bent to the shape of the image 2. This bending may be done away from piece 3 and then matched to the shape of image 2 or preferably the tubing is bent directly on sheet 3. Since the tubing can only be bent at the softening point of the glass it is apparent that the range of materials suitable for sheet 3 is rather limited. Once glass tubing 4 is bent to the shape of image 2 electrodes are sealed into tubing 4 and the assembly evacuated and filled with an appropriate gas or vapor suitable to produce the color desired. Selection of gas, attachment of electrodes and evacuation are all well known methods in the sign art and are not described further.

A particularly suitable material for sheet 3 is a silicone impregnated fiberglass. This material is produced from a sheet of commercially available fiberglass. The fiberglass used must be thin and tightly woven. The type of glass used is designated as an E-glass. A second suitable glass is designated as S-2 glass. The fabric used is preferably a glass fabric having a warp and fill of $44\times32$ picks per inch. The fabric is usable if from $30\times30$ to $120\times120$ picks per inch, however. A preferred weight of the fabric is 6 oz/yd which results in a thickness of 0.0067 inches. A range of from 5 to 7 oz. per square yard is usable which translates to thickness of from 0.006" to 0.008". This type of fabric is commonly designated as style 7628. This material has been proven to be satisfactory, but of course, any such material giving a product all of the essential characteristics of translucense, heat resistance and flexibility would be suitable. The fiberglass cloth is then dipped in a solution which includes a silicone emulsion, titanium dioxide and a flame retardant. The dipped product is next passed through pinch rollers at a rate of 10–12 feet/minute to remove excess solution. After passing through the rollers the fabric is passed through a furnace to dry. For this solution a single pass through a 600° F. furnace at an effective rate to dry the solution but rapid enough so that there is no emulsion burning, and the resultant coated fabric achieves the preferred "body" or boardiness or stiffness similar to asbestos paper, is sufficient. Of course, other conventional methods of coating such as knife coating, calendaring, kiss coating, etc., can be substituted. Fabric so treated can be rolled and shipped conveniently.

A particularly suitable solution includes a 1 to 1 mixture of a silicone water based elastomer and water. A particularly suitable emulsion is sold by Dow Corning, a registered trademark, under their designation 3-5025.

This emulsion is a white colored liquid having little odor and a solubility in water of over 90%. To the water/emulsion mix is added from 2 to 10 parts titanium dioxide or other refractory whitening agent which acts to whiten the cloth and increase its refractoriness. A particularly suitable whitener is titanium dioxide commercially sold by Nuodex Corporation as 877-0018 which is supplied as an emulsion in water. If more than 10% titanium dioxide is used the cloth becomes too opaque to see image 2. It is realized that other equivalent pigments could be substituted for titanium dioxide. The titaniuim dioxide both allows the cloth to be directly drawn on and protects the fabric. To the above mixture is added a flame retardant. A suitable flame retardant is an aqueous dispersion of decabromo diphenyl oxide brominated aromatic and antimony trioxide ($C_{12}Br_{10}Ox\ Sb_2O_3$) (DBOAT). Such a material is supplied by White Chemical Corporation of Newark, N.J. under the trademark Caliban F/R P-44. The material has a specific gravity of 2 and includes 31.5% solid materials and is completely soluble in water. It is realized that an equivalent flame retardant could be substituted.

The material so formed is thus provided with a coating of from 0.25 to 2 mils on each side. If the coating is thicker than 2 mils per side the material is unsuitable for use. This forms an ablative coating which functions to protect the underlying fabric.

EXAMPLE 1

Fiberglass fabric was dipped in a solution having 50 parts Dow Corning 3-5025 silicone emulsion, 50 parts water, 2 parts titanium dioxide and 1 part DBOAT. The cloth was then run through two pinch rollers and dried in a 600° F. oven. The resulting product was suitably boardy, translucent and suitable for use in producing signs.

EXAMPLE 2

Fiberglass fabric was dipped in a solution having 50 parts Dow Corning 3-5025 silicone emulsion, 50 parts water, 12 parts titanium dioxide and 1 part DBOAT. The cloth was then run through two pinch rollers and dried in a 600° F. oven. The resulting product was semi-flexible (suitably boardy) and suitable for use as substrate for bending tubing but was insufficiently translucent to allow viewing a drawing although the fabric but could be used with a transferred figure.

EXAMPLE 3

Fiberglass fabric was dipped in a solution having 50 parts Dow Corning 3-5025 silicone emulsion, and 50 parts water. The cloth was then run through two pinch rollers and dried in a 600° oven. The resulting product was flexible and translucent but when exposed to the heat of molten glass was rapidly destroyed.

EXAMPLE 4

Fiberglass fabric was dipped in a solution having 50 parts Dow Corning 3-5025 silicone emulsion, 50 parts water, 3 parts titanium dioxide and 3 parts DBOAT. The cloth was then run through two pinch rollers and dried in a 600° oven. The resulting product was flexible, translucent but unsuitable for use in bending tubing due to unacceptable smoke emission.

The above examples are explemplary only the invention being defined solely by the attached claims.

I claim:

1. A method for producing neon signs comprising the steps of:

drawing the design on a sheet of material; and, covering the material and the design drawn on the material with a sheet of translucent heat resistant material; and, bending glass tubing to the shape of the design drawn over the sheet of translucent heat resistant material; and, fitting the bent tubing with electrodes and a low pressure gas.

2. The method of claim 1, wherein said bending step the glass tubing is in contact with said sheet of translucent heat resistant material.

3. The method of claim 1, wherein said material used in the drawing step is paper.

4. The method of claim 1, wherein said sheet of translucent material is treated fiberglass.

5. The method of claim 4, wherein said treated fiberglass material is treated with a solution including a silicone elastomer, and water.

6. The method of claim 5, wherein said solution further includes a pigment.

7. The method of claim 6, wherein said pigment is titanium dioxide.

8. The method of claim 5, wherein said solution further includes a flame suppressant.

* * * * *